United States Patent [19]

Yaguchi

[11] 4,248,057

[45] Feb. 3, 1981

[54] AIR CONDITIONER

[75] Inventor: Shoji Yaguchi, Kawasaki, Japan

[73] Assignee: The General Corporation, Kawasaki, Japan

[21] Appl. No.: 935,918

[22] Filed: Aug. 23, 1978

[30] Foreign Application Priority Data

Aug. 26, 1977 [JP] Japan ..... 52/102434

[51] Int. Cl.[3] ..... F25B 47/00; F25B 39/04

[52] U.S. Cl. ..... 62/280; 62/183

[58] Field of Search ..... 62/280, 183

[56] References Cited

U.S. PATENT DOCUMENTS

| | | | |
|---|---|---|---|
| 2,777,303 | 1/1957 | Slattery | 62/280 X |
| 2,911,800 | 11/1959 | McMillan | 62/280 |
| 2,941,382 | 6/1960 | Wuesthoff | 62/280 |
| 2,961,843 | 11/1960 | McMillan et al. | 62/280 X |
| 3,872,684 | 3/1975 | Scott | 62/183 |

*Primary Examiner*—Lloyd L. King

*Attorney, Agent, or Firm*—Robert E. Burns; Emmanuel J. Lobato; Bruce L. Adams

[57] ABSTRACT

An air conditioner of heat pump type including a pair of indoor and outdoor heat exchangers, and a propeller fan interposed therebetween. The both heat exchangers and the propeller fan are mounted on a bottomplate member which also serves as a receptacle for a condensate. A slinger ring is disposed around the propeller fan for throwing the condensate toward the outdoor exchanger. Below the fan, the bottomplate member is formed with a drain port, which is positioned in a region which is free from a pool of water formed under the pneumatic pressure of the fan.

7 Claims, 3 Drawing Figures

AIR CONDITIONER

FIELD OF THE INVENTION

The invention relates to an electrical air conditioner, and more particularly, to a condensate treating system of an air conditioner of heat pump type.

A self-contained air conditioner is well known which integrally includes an indoor and an outdoor heat exchangers. The air conditioner of this type has been primarily used for room air cooling purpose, i.e. for reducing the room temperature. Recently, an air conditioner is provided which permits a warming of room air through the switching of a refrigerant path.

An air conditioner of heat pump type described above includes a casing, the interior of which is separated into an indoor space in which an indoor heat exchanger is disposed and an outdoor space in which an outdoor heat exchanger is disposed. A motor is mounted on a partition wall and has a double shaft, one of which supports a sirocco fan disposed within the indoor space while the other shaft supports a propeller fan disposed within the outdoor space. The sirocco fan operates to deliver the air into the chamber again which has been once withdrawn from the chamber through the indoor heat exchanger while the propeller fan withdraws the outdoor air and directs it against the outdoor heat exchanger. When the arrangement is used for the purpose of reducing the room temperature, it is known to improve the efficiency of the outdoor heat exchanger by introducing the condensate which has precipitated on the indoor exchanger into a region below the propeller fan so that it can be splattered or thrown toward the outdoor exchanger by means of a slinger ring disposed around the propeller fan. This achieves a cooling effect by reducing the temperature of the air being withdrawn and by the evaporation of the condensate which is sprayed onto the outdoor heat exchanger.

DESCRIPTION OF THE PRIOR ART

U.S. Pat. No. 2,491,382 issued to E. M. Wuesthoff on June 21, 1961 discloses a slinger ring which is disposed around the propeller fan for scooping the condensate which is maintained in a pool below the fan to be splattered toward the outdoor heat exchanger. The rotation of the propeller fan at a high rate produces a region within the pool where the condensate is cleared by the influence of the pneumatic or wind pressure. A guide plate is provided to prevent a flow of the condensate to such region. In this manner, the slinger ring is maintained in effective contact with the condensate in the pool, thus assuring a spraying of the condensate over the outdoor heat exchanger.

The described arrangement is directed to reducing the room temperature. However, when it is used for purpose of room air heating, the outdoor heat exchanger is used as an evaporator, and hence produces a condensate which may deposit on the outdoor heat exchanger in the form of frost under low temperatures. With a further reduction in the temperature of the atmosphere, the condensate will be immediately converted into frost. Hence, a defrosting is performed in known manner by interrupting the operation of the propeller fan. Upon melting, the condensate accumulates in a pool and becomes frozen as a result of its being cooled by the outdoor exchanger when the external air temperature is low or becomes frozen immediately and naturally at further reduced temperatures. This in turn cools the bottom portion of the outdoor heat exchanger, disadvantageously preventing a defrosting of such portion. If the room air heating operation is continued with an incomplete defrosting, there occurs a growth of the frost which freezes the fan to immobilize it. In particular, when the slinger ring is disposed in contact with the upper level of the condensate pool, the condensate may become frozen with the outer periphery of the ring entrapped therein. This can be avoided by providing a drain port for the pool at a lower position. However, the cooling effect which is achieved by the splattering of the condensate during the room air cooling operation is then reduced. It will thus be seen that the splattering of the condensate over the outdoor heat exchanger during the room air cooling operation is incompatible with the provision of a drain port for the condensate for purpose of preventing the freezing of the outdoor heat exchanger or propeller fan during the room air heating operation. The described prior art proposes no solution which is addressed to this problem.

SUMMARY OF THE INVENTION

It is an object of the invention to provide an air conditioner of heat pump type which maintains a pool of condensate during the room air cooling operation and which drains the condensate to the exterior during the room air heating operation.

In accordance with the invention, there is provided an air conditioner including a bottomplate member, an indoor heat exchanger disposed on the indoor side of the bottomplate member, an outdoor heat exchanger disposed on the outdoor side of the bottomplate member, a propeller fan disposed intermediate the both heat exchangers and rotatable about a horizontal shaft for directing an external air to the outdoor heat exchanger, and a slinger ring mounted on the propeller fan, the bottom member being formed so that condensate which is drained from either one of the heat exchangers is introduced into a region below the propeller fan. In accordance with the invention, the bottomplate member is formed with a drain port in a region thereof on a side of a vertical plane including the horizontal shaft of the propeller fan that is located advanced as viewed in the direction of rotation of the propeller fan and which is subject to a tangential pneumatic or wind pressure from the end of the blades of the fan. During the rotation of the propeller fan, condensate which is admitted into the region below the fan is driven by the slinger ring toward the outdoor heat exchanger while when the propeller fan remains at rest, the condensate in this region is externally led through the drain port.

The invention is based on the recognition that a water-free region is formed below the propeller fan as a result of rotation thereof where the condensate is locally expelled by the influence of pneumatic pressure, as described in the cited U.S. Patent, and the drain port is formed in this region. The condensate cannot move into the vicinity of the drain port during the rotation of the propeller fan, so that a pool of condensate can be maintained during the room air cooling operation, assuring that the condensate will be thrown toward the outdoor heat exchanger by means of the slinger ring. The propeller fan remains stationary during a defrosting in the room air heating operation, and hence the condensate can be reliably led externally through the drain port.

Other objects and advantages of the invention will become apparent from the following description of the preferred embodiment of the invention.

DESCRIPTION OF PREFERRED EMBODIMENT

Figure 1:
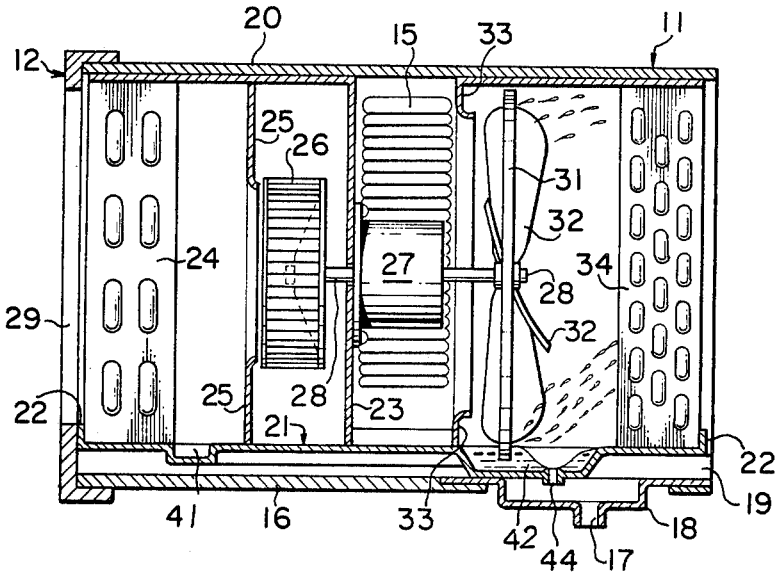
FIG. 1 is a schematic side elevation partly in section, of an embodiment of the invention.

Referring to the drawings, the air conditioner includes an external casing 11 of box-shaped configuration including side walls 13, 14, bottomplate 16 and top plate 20. Both front and rear ends of the casing remain open. A face panel 12 is fitted around the front end or the indoor opening of the casing 11. Both side walls 13, 14 are formed with ventilators 15 for admitting outdoor air. A drainage receiver 18 having a drain port 17 is mounted on a portion of the bottomplate 16 adjacent to the rear end or outdoor side thereof. The bottomplate 16 is provided with a pair of guide plates 19 along its opposite sides.

An internal bottomplate 21 is placed on top of the guide plates 19, and is formed with an upstanding edge 22 over it entire periphery, whereby the whole bottomplate 21 serves as a drainage receiver. A partition 23 is provided on the bottomplate 21 to divide the air conditioner into an indoor and an outdoor space. An indoor heat exchanger 24 is located adjacent to the front end of the indoor space on the bottomplate 21, and baffle plates 25 are located between the exchanger 24 and partition 23 so as to surround the former. A sirocco fan 26 is disposed between baffle plates 25 and partition 23, and is mounted on a rotary shaft 28 of a fan motor 27 which is mounted on the partition 23. When the sirocco fan 26 rotates, it withdraws the indoor air through an inlet port 29 formed in the panel 12 and through the indoor heat exchanger 24, and the air is discharged through an indoor outlet port 30, also formed in the panel 12, after passing through a passage which is defined by partition 23 and baffle plates 25.

The rotary shaft 28 of fan motor 27 also extends to the outdoor side, and carries a propeller fan 32 thereon which is provided with a slinger ring 31. Baffle plates 33 are disposed between partition 23 and propeller fan 32 for admitting the air from ventilators 15 into the propeller fan 32. Outdoor heat exchanger 34 is disposed on the internal bottomplate 21 adjacent to the front end of the outdoor space. When the fan motor 27 is driven to rotate the propeller fan 32, the outdoor air is admitted through ventilators 15 into the passage defined by partition 23 and baffle plate 33, and is withdrawn by propeller fan 32 to be discharged to the outdoor again after passing through outdoor heat exchanger 34. A compressor 35 is disposed on the internal bottomplate 21 within the passage defined by partition 23 and baffle plate 33. The two heat exchangers 24, 34 and the compressor 35 are connected into a closed loop to form a heat pump.

Figure 3:
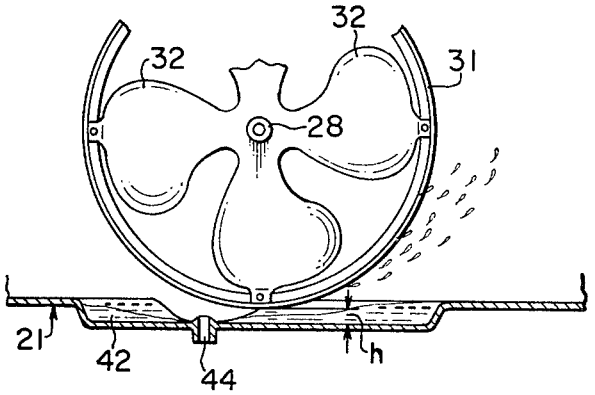
FIG. 3 is a fragmentary front view of the propeller fan and the condensate pool taken along the line 3—3 shown in FIG. 2.
Figure 2:
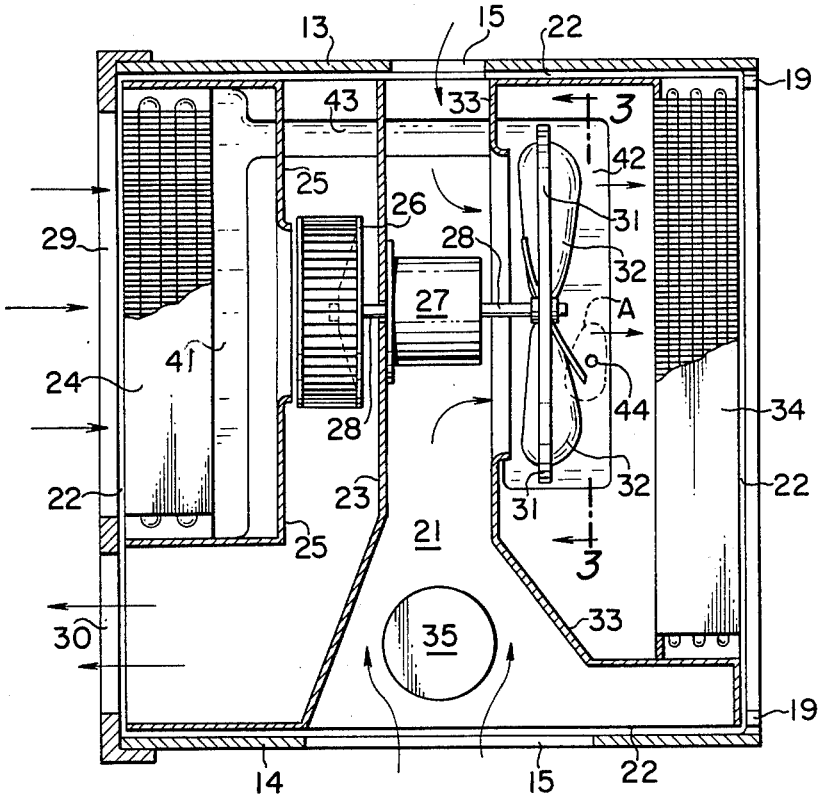
FIG. 2 is a top plan view, partly cut-away, of the air conditioner shown in FIG. 1.

A recess 41 is formed in the bottomplate 21 below the indoor heat exchanger 24 for receiving the condensate, and communicates with a water receiver 42 located directly below the propeller fan 32 through a channel 43. Receiver 42 is formed with condensate removal means in the form of a drain port 44 in a water-free region A (see FIG. 2) which is formed during the rotation of the propeller fan 32 at a location on a side of a vertical plane including the rotary shaft 28 that opposes or is advanced as viewed in the direction of rotation of the fan and which is most strongly subject to a tangential wind pressure from the blade ends of the propeller fan 32. The drain port 44 is located slightly offset from the axis of the rotary shaft 28 and nearer the outdoor heat exchanger 34. It is located above the receiver 18 formed in the external casing 11. The drain port 44 has an opening edge which is slightly raised with respect to the remainder of the upper surface of the receiver 42, as shown in FIG. 3. It can be integrally molded with the internal bottomplate 21 as by press molding.

In operation, in a room air cooling operation, the indoor heat exchanger 24 operates as a cooling unit while the outdoor heat exchanger 34 as a condenser. When compressor 35 and fan motor 27 are set in motion, water droplets deposit on the indoor heat exchanger 24 as a result of moisture contained in the indoor air, the droplets are collected in the recess 41 and flow through channel 43 to the receiver 42 which is located directly below the propeller fan 32 disposed in the outdoor space. When the axial flow propeller fan 32 is set in motion, the resulting wind flows in a direction parallel to the rotary shaft 28, and simultaneously also flows in the same direction as that of the rotation of the fan. Specifically, a tangential flow is produced by the end of the fan blades. Water which has been conducted to receiver 42 is subjected to the dynamic wind pressure, with the consequence that a water-free region A is produced where the action of the forward and tangential wind pressure is at its maximum. Since the drain port 44 is formed within the region A, the condensate entering the receiver 42 cannot be drained wastefully, whereby the slinger ring 31 on the propeller fan 32 engages and splatters the condensate which is displaced to one side of the receiver 42, conveying it on the axial flow for distribution around the outdoor heat exchanger 34 to thereby enhance the cooling effect. The fan motor 27 is maintained in rotation during the room air cooling operation, independently from the on or off position of a room air temperature regulator, so that the distribution of the condensate over the outdoor heat exchanger 34 is continued, contributing to increasing the cooling capacity. When the room air cooling operation is interrupted, there is no wind pressure acting on the region A, whereby the condensate is drained through the port 44 to be discharged outside the air conditioner through the drain port 17. Consequently, when the room air cooling operation is interrupted, there is no residue of water in the receiver 42, and hence there occurs no freezing of condensate under reduced external temperatures, preventing an interference with the propeller fan or slinger ring 31, and a consequent locking of the fan motor 27. Though it may appear that the cooling efficiency is reduced at the outset of the room air cooling operation since then the outdoor heat exchanger 34 is only subjected to the wind fed from the propeller fan 32, the exchanger 34 can be effectively cooled by the wind from the fan 32 since its temperature is low under the starting condition. As the operation is continued, condensate is produced on the indoor heat exchanger 24. The condensate cannot be led through the drain port 44 so long as the propeller fan is maintained in rotation.

In a room air heating operation, a four-way valve (not shown) is operated to switch the refrigerant path so that the indoor heat exchanger 24 operates as a heat radiator and the outdoor heat exchanger 34 as a heat absorber. In this instance, the moisture contained in the external atmosphere may cause the deposition of water droplets on the outdoor exchanger 34 which may form a frost when the exterior temperature is low. Consequently, it is necessary to provide a periodic defrosting during the room air heating operation, and to drain the condensate which results from the defrosting immediately without splattering it over the outdoor exchanger 34. Defrosting usually takes place while the fan motor 27 remains at rest. Hence, the defrosted water droplets or condensate is not subject to any wind pressure from the propeller fan 32, but is immediately drained to the outside through the drain port 44. As a consequence, there occurs no frozen condensate which would lock the bottom of the outdoor heat exchanger 34 or the slinger ring 31 on the propeller fan 32 with the receiver 42 as experienced in the conventional arrangement, but instead a continued room air heating operation is assured.

As described, the drain port 44 is located in accordance with the invention in water-free region A in the receiver 42 which is most strongly subject to the wind pressure from the propeller fan 32. Since the region A has a relatively large area depending on the size and the rotational speed of the propeller fan, if may be located anywhere within region A and spaced from the lowest point on the slinger ring 31, by providing an edge of the opening of drain port 44 which is slightly raised, without reducing the gap h (see FIG. 3) between the slinger ring 31 and receiver 42. In this manner, outflow of the condensate through drain port 44 which might occur as a result of surface tension thereof can be prevented during the room air cooling operation. By experiments, it has been found that a preferred location for the drain port 44 is about 61 mm from the central plane of the propeller fan toward the outdoor exchanger and at a distance of 80 mm from the axis of the rotary shaft, as viewed in the direction of rotation of the propeller fan, when the propeller fan has six blades having a diameter of 385 mm, for example, and a windage of 1,300 $m^3$/hr. In this instance, a drain port has a diameter of 10 mm and its edge is raised 3 mm above the upper surface of the receiver and the distance of the gap h is 6 mm.

In the above embodiment, recess 41, receiver 42 and channel 43 are provided to conduct the condensate to a position directly below the slinger ring 31. However it will be readily appreciated that such recess and associated channel can be dispensed with by using the entire inner bottomplate 21 as a condensate trough. Alternatively, the bottomplate 21 may be provided with receiver 42 alone, and a separate receiver provided below the indoor exchanger 24, with a condensate formed therein being conveyed to the receiver 42.

While the invention has been described with reference to a particular embodiment, it should be understood that various changes and modifications can be made therein by those skilled in the art without departing from the spirit of the invention.

What is claimed is:

1. In an air conditioner including a bottomplate member, an indoor heat exchanger disposed on the bottomplate member in an indoor space, an outdoor heat exchanger disposed on the bottomplate member in an outdoor space, a propeller fan disposed within the outdoor space and rotatable about a horizontal axis for directing external air through the outdoor heat exchanger to the outdoors, said fan being positioned upstream from the outdoor heat exchanger so that during rotation of the fan the region between the fan and the outdoor heat exchanger increases in wind pressure as compared to the remaining portion of the outdoor space, and a slinger ring mounted on the propeller fan, the bottomplate member being formed to conduct a condensate formed on one of the heat exchangers to an area below the propeller fan; the improvement which comprises means defining a drain port in the bottomplate member positioned below the high pressure region between the fan and the outdoor heat exchanger and positioned at a region located on the side of a vertical plane passing through the horizontal axis that is advanced as viewed in the direction of rotation of the propeller fan and which is subjected to tangential wind pressure from the end of the blades of the propeller fan whereby the condensate conducted to said area below the propeller fan is directed toward the outdoor heat exchanger by means of the slinger ring during the rotation of the propeller fan and is discharged to the outside through the drain port when the propeller fan remains at rest.

2. An air conditioner according to claim 1 in which the drain port has an opening edge which is raised above the upper surface of the remainder of the bottomplate member in the vicinity of said area below the propeller fan.

3. An air conditioner according to claim 1 in which the bottomplate member is formed with a recess effective to gather the condensate at a position below the propeller fan, the drain port being formed in the recess.

4. An air conditioner according to claim 1 in which the bottomplate member is formed with recesses which receive the condensates at positions below the indoor heat exchanger and below the propeller fan, the both recesses being maintained in communication with each other by a channel-shaped recess, the drain port being formed in the recess which is located below the propeller fan.

5. An air conditioner according to claim 3 or 4 in which the drain port has an opening edge which is raised above the upper surface of the remainder of the recess formed below the propeller fan.

6. In an air conditioner having an indoor heat exchanger, an outdoor heat exchanger, a rotary propeller fan disposed between the indoor and outdoor heat exchangers for withdrawing and directing external air to the outdoor heat exchanger, a slinger ring mounted on the propeller fan, and a bottomplate member disposed beneath said heat exchangers and propeller fan and having recessed portions effective to conduct condensate formed on one of the heat exchangers to an area below the propeller fan; the improvement comprising condensate removal means coacting with the dynamic wind pressure created during rotation of the propeller fan for preventing discharge of condensate collected within the recessed portion of said bottomplate member in the area below the propeller fan and effective during periods of non-rotation of said propeller fan for effecting removal of condensate collected within the recessed portion of said bottomplate member in said area below the propeller fan, said condensate removal means comprising means defining a drain port in said bottomplate member disposed forward of the propeller fan in a direction toward the other of the heat exchangers and offset from the axis of rotation of the propeller fan in the direction of rotation of the propeller fan so that the action of the forward and tangential wind pressure created by the rotating propeller fan prevents the condensate from flowing out the drain port during the periods of rotation of the propeller fan.

7. The air conditioner according the claim 6; wherein said means defining the drain port comprises means defining a drain port having an open edge raised above the level of the surrounding surface of the bottomplate member.

* * * * *